US007504572B2

(12) United States Patent
Nakamura

(10) Patent No.: US 7,504,572 B2
(45) Date of Patent: Mar. 17, 2009

(54) SOUND GENERATING METHOD

(75) Inventor: Shunsuke Nakamura, KItakyushu (JP)

(73) Assignee: National University Corporation Kyushu Institute of Technology, Kitakyushi-shi (JP)

( * ) Notice: Subject to any disclaimer, the term of this patent is extended or adjusted under 35 U.S.C. 154(b) by 202 days.

(21) Appl. No.: 11/631,398

(22) PCT Filed: Jul. 7, 2005

(86) PCT No.: PCT/JP2005/012539

§ 371 (c)(1),
(2), (4) Date: Dec. 29, 2006

(87) PCT Pub. No.: WO2006/011342

PCT Pub. Date: Feb. 2, 2006

(65) Prior Publication Data

US 2008/0168893 A1 Jul. 17, 2008

(30) Foreign Application Priority Data

Jul. 29, 2004 (JP) ..... 2004-20998

(51) Int. Cl.
*G10H 1/00* (2006.01)
*A63J 17/00* (2006.01)

(52) U.S. Cl. ..... 84/600; 84/464 R; 715/727

(58) Field of Classification Search ..... 84/464 A, 84/464 R, 600; 715/727, 275
See application file for complete search history.

(56) References Cited

U.S. PATENT DOCUMENTS 5,192,826 A * 3/1993 Aoki ..... 84/737
5,247,131 A * 9/1993 Okamoto et al. ..... 84/658
5,448,008 A * 9/1995 Okamoto et al. ..... 84/658
5,768,393 A * 6/1998 Mukojima et al. ..... 381/17
5,920,024 A * 7/1999 Moore ..... 84/609
6,686,529 B2 * 2/2004 Kim ..... 84/464 R

FOREIGN PATENT DOCUMENTS

JP 3-206493 9/1991

(Continued)

OTHER PUBLICATIONS

International Search Report dated Oct. 18, 2005.

*Primary Examiner*—Jeffrey Donels
(74) *Attorney, Agent, or Firm*—Kratz, Quintos & Hanson, LLP

(57) ABSTRACT

A sound is output by calculating a change in coordinate data as a vector and generating sound data corresponding to the calculated vector, so that sounds can be freely obtained without being limited by the size of or positions on an input coordinate plane. A sound generating apparatus 10 includes a coordinate input device 12 for inputting coordinate data, a main control device 14, an acoustic device 16, and a display device 18. The main control device 14 includes: a motion calculation unit 20 that calculates a vector between two successive sets of the coordinate data input with a predetermined time interval; a sound data generating unit 22 that generates the sound data based on the calculated vector; a musical instrument data generating unit and displayed-color data generating unit 24 that serves both functions of generating musical instrument data and generating displayed-color data based on the coordinate data; a data transfer and saving unit 26; and a MIDI sound source 28 controlled by the sound data.

4 Claims, 5 Drawing Sheets

FOREIGN PATENT DOCUMENTS

| | | |
|---|---|---|
| JP | 6-175652 | 6/1994 |
| JP | 2002-182647 | 6/2002 |
| JP | 2003-271164 | 9/2003 |
| JP | 8-335076 | 12/2006 |
| WO | WO 96/22580 | 7/1996 |

* cited by examiner

[Figure 1]
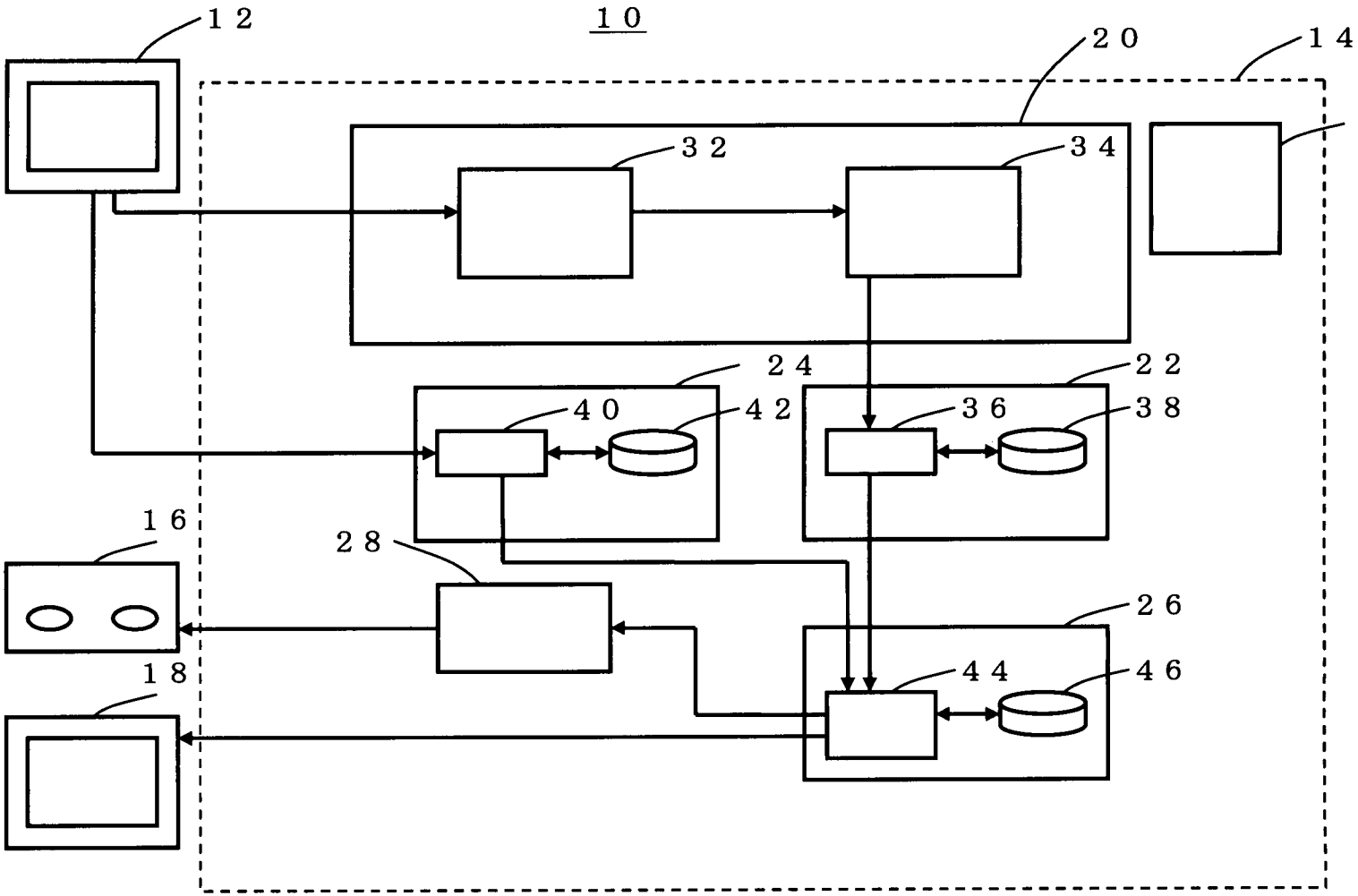

[Figure 2]
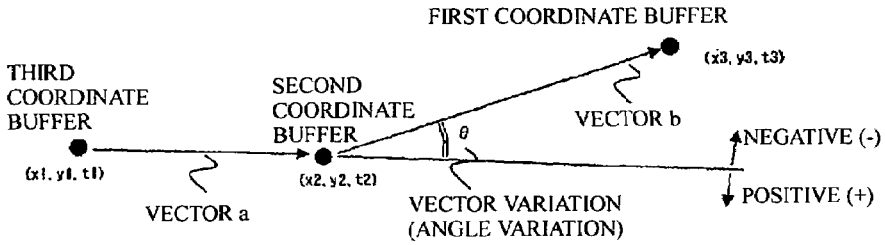
[Figure 3]
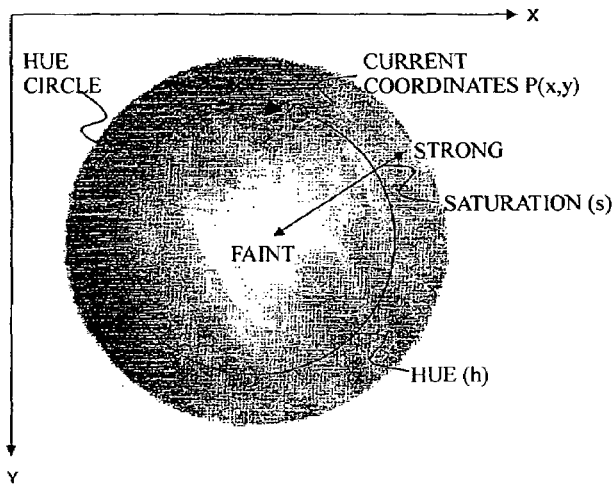
[Figure 4]
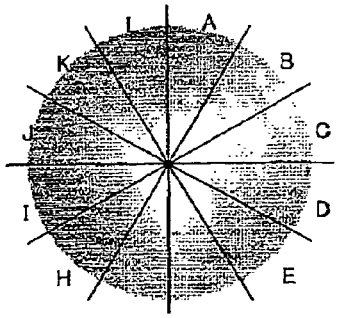

[Figure 5]
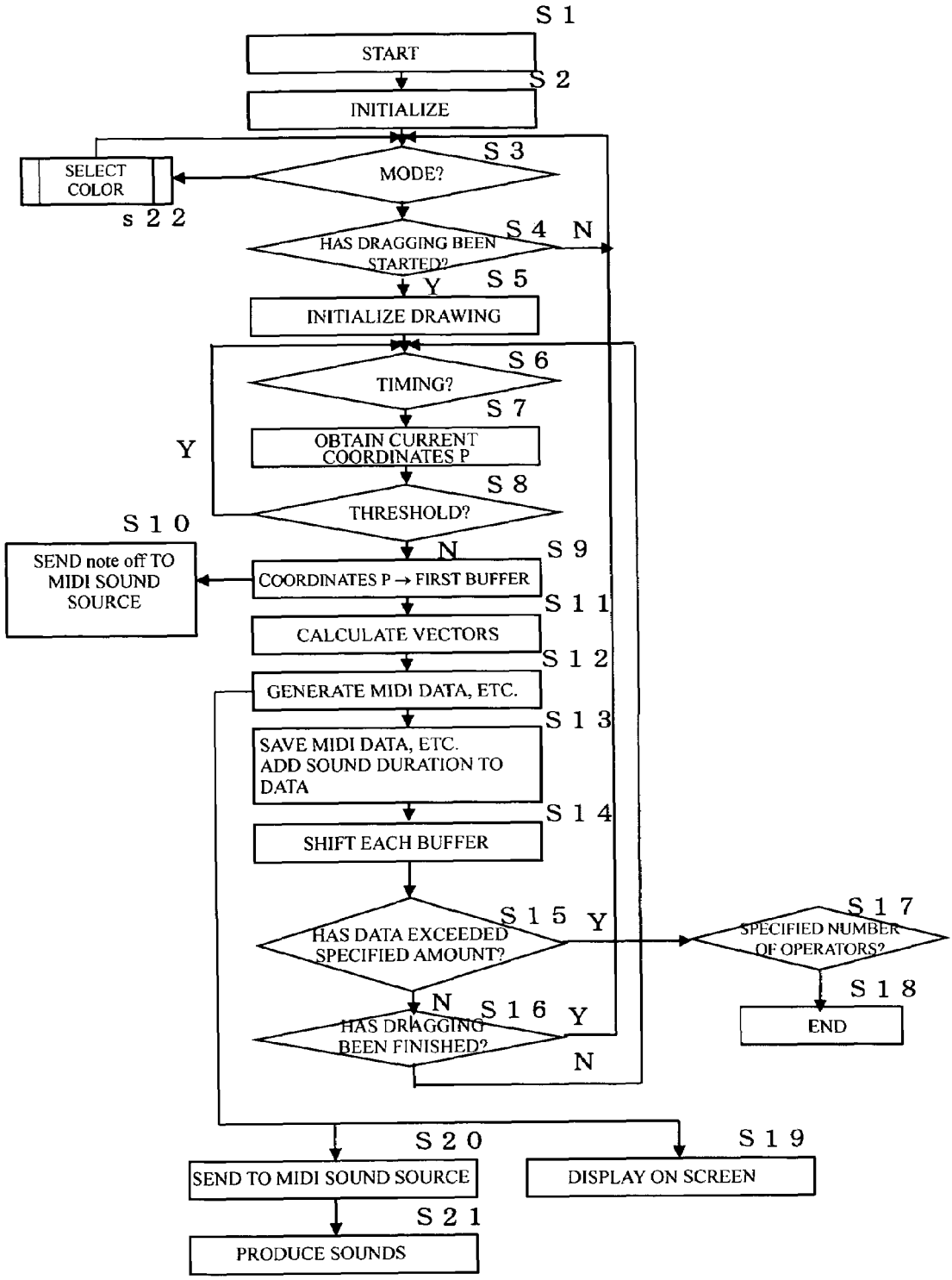

[Figure 6]
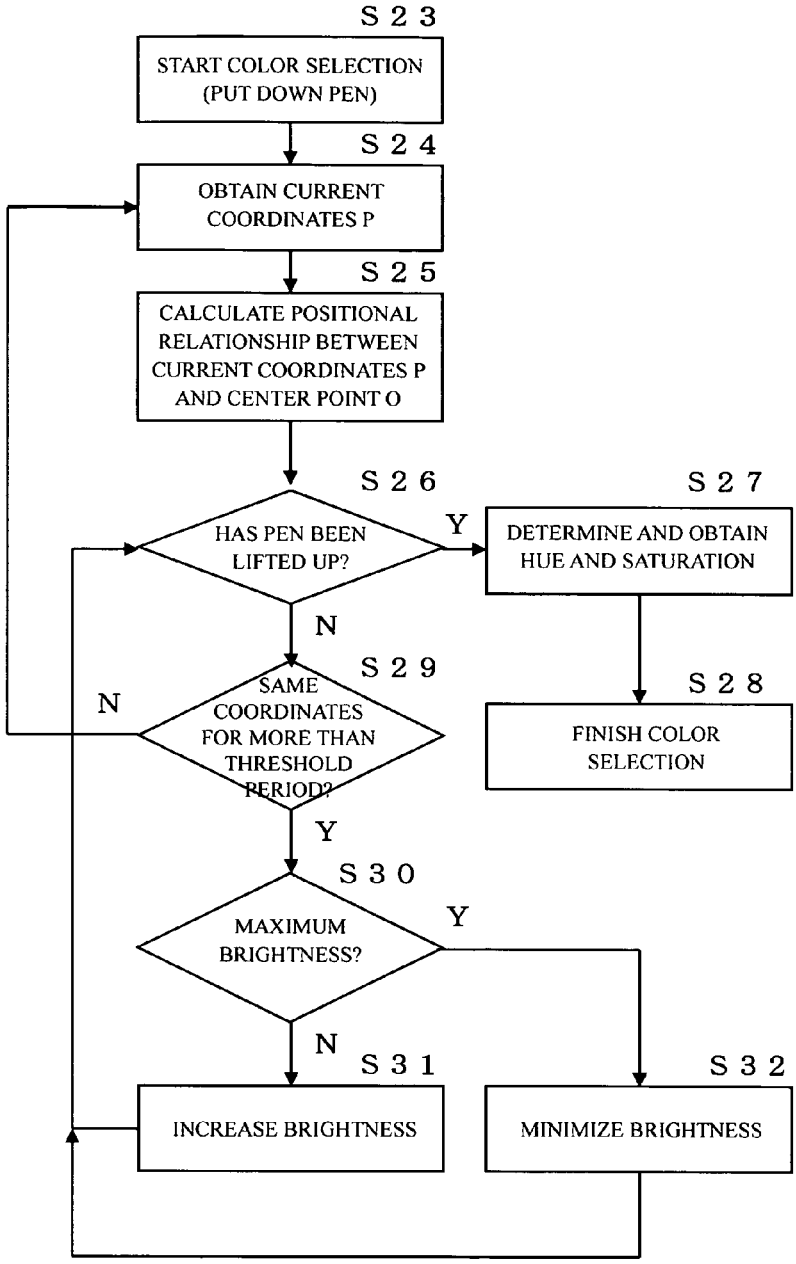

[Figure 7]
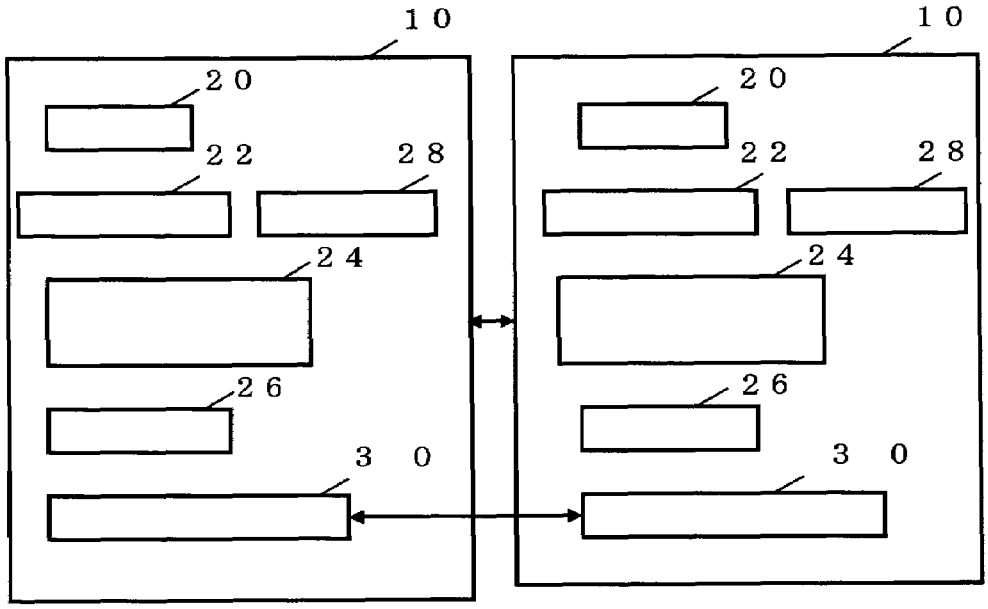
[Figure 8]
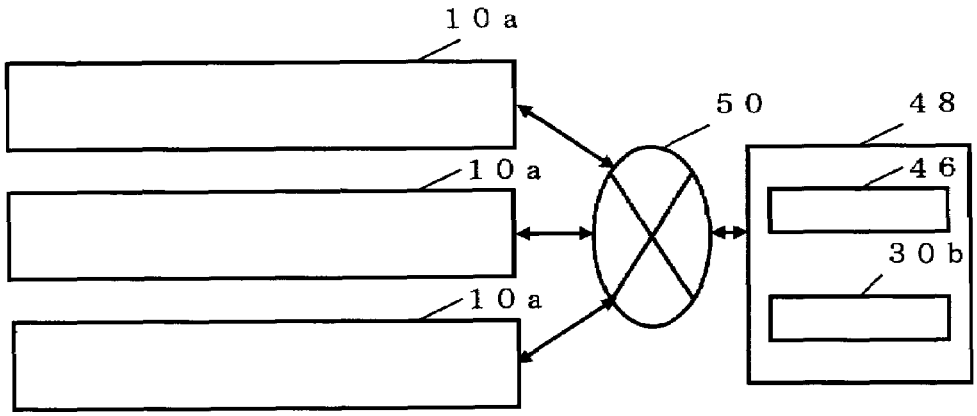

SOUND GENERATING METHOD

TECHNICAL FIELD

The present invention relates to a sound generating method for generating sounds based on input coordinate data.

BACKGROUND ART

In recent years, music playing systems using computers are rapidly becoming popular. Generally, the music playing systems are aimed at enjoying composing and arranging music and require musical expertise and skills.

On the other hand, systems have also been proposed that are easy to use and entertaining, such as those visualizing scores as images by replacing the scores with graphics and colors, and those synchronizing music with changes in images.

As an example of such systems, a music playing system has been proposed that includes: a pen-shaped input device for inputting coordinate information about a drawn picture; a display device for displaying the coordinate information input from the pen-shaped input device; a sound source device for outputting sound signals corresponding to the coordinate information input from the pen-shaped input device; and a main control device for controlling the display device and the sound source device based on the coordinate information input from the pen-shaped input device. According to this music playing system, tones of a musical instrument used are replaced with colors on an input screen, and a user freely selects colors among color variations and puts the colors on a display screen. Thus, in addition to the pleasure of listening to sounds, this system is supposed to provide visual pleasure (see Patent Document 1).

However, in the above music playing system, a sound signal corresponding to a position where the pen is placed for drawing is a sound signal assigned to the coordinate position. Sound signals for respective coordinate positions are generated and recorded in advance when a picture is drawn, and thereafter the drawn picture is traced to reproduce the sound signals for the coordinate positions. That is, rather than sound signals generated by drawing a picture, sound signals for coordinate positions are reproduced based on where the pen is placed on the screen during tracing of the drawn picture. Therefore, it is actually impossible to generate arbitrary sounds based on an arbitrarily drawn picture, and the pen should be operated as defined by positions on the screen. In addition, the pen must be moved at exactly the same positions on the screen in order to reproduce music.

A sound generating method has been proposed that includes an image displaying step of displaying input images in order of input in a drawing area having a preset coordinate system, and a sound generating step of generating a sound corresponding to the coordinates of an image portion being displayed in the coordinate system. The coordinate system is configured with a first coordinate axis determining the sound pitch and a second coordinate axis determining the sound volume balance between the right and left. According to this sound generating method, it is supposed that the reproduced drawing and sounds can be made identical with the input drawing and sounds (see Patent Document 2). A mouse click operation adds a tempo factor, so that a phrase is generated.

However, in the above sound generating method (Patent Document 2), a generated sound is a sound having the pitch and volume assigned to a coordinate position (a coordinate point). That is, uniquely obtaining a sound having a specific pitch and volume requires inputting a specific coordinate point in the plane coordinate system. In addition, a generated phrase is determined with a mouse operation at a specific coordinate point in the plane coordinate system. In these senses, as in the above-described music playing system (Patent Document 1), it can be said that this sound generating method (Patent Document 2) has a small degree of freedom with which sounds are generated based on an arbitrarily created drawing.

In this respect, a parameter input apparatus for electronic musical instruments has been proposed for the purpose of improving the operability by using a tablet to input tone parameters and effect parameters for a musical instrument (see Patent Document 3). In this apparatus, operation points on the tablet are sampled and vectors $V_k$ connecting the sampling points $P_k$ (k=0, 1, 2, . . . ) are assumed. A parameter is increased or decreased according to the rotation angle of the direction of a current vector against the direction of a vector $V_0$ obtained at the beginning of the operation. Whether increasing or decreasing the parameter value depends on the rotation direction at the operation point, and the rotation direction at the operation point is detected based on the difference (variation) in the inclination of the vectors.

Patent Document 1: Japanese Patent Laid-Open No. 8 -3350756

Patent Document 2: Japanese Patent Laid-Open No. 2003-271164

Patent Document 3: Japanese Patent Laid-Open No. 6 -175652

However, in the above parameter input apparatus for electronic musical instruments (Patent Document 3), the object controlled based on the vectors is the increase or decrease of values such as the tone parameter. Settings for the tone parameter itself are changed by a parameter input device such as a mode setting switch, which is input means separate from the tablet. Therefore, as in the above-described other conventional art, it can be said that there is a small degree of freedom with which sounds are generated based on an arbitrarily created drawing.

The present invention has been made in view of the above problems, and an object thereof is to provide a sound generating method that allows arbitrarily producing a sound and arbitrarily selecting a drawing color substantially only with drawing operations.

DISCLOSURE OF THE INVENTION

To accomplish the above object, a sound generating method according to the present invention is characterized by including: a drawing and sound producing step of setting a drawing screen and producing a drawing by successively inputting coordinate data with a pen or mouse, and producing a sound by calculating two vectors from three successive sets of the coordinate data input at predetermined time intervals and generating sound data, the sound data having a sound pitch determined based on an angle variation between the calculated two vectors, a sound intensity determined based on a scalar quantity of the calculated two vectors, and a sound lenath determined based on a scalar quantity level of the calculated two vectors: and a displayed-color data generating step of temporarily displaying a hue circle on the drawing screen and moving a coordinate position with the pen or mouse to determine and generate displayed-color data to be displayed out of gradually changing displayed-color data, wherein operation using the pen or mouse causes the sound along with the drawing to be output and the displayed-color to be changed.

The sound generating method according to the present invention is characterized in that the drawing and sound producing step includes generating sound data on only tones of a certain scale based on the angle variation between the vectors.

The sound generating method according to the present invention is characterized in that the displayed-color data generating step includes generating musical instrument data along with the displayed-color data, wherein the hue circle is segmented by musical instrument.

The sound generating method according to the present invention is characterized by further including the step of recording data sets including separately input coordinate data sets and separately generated sound data sets, displayed-color data sets, and musical instrument data sets, and synchronously reproducing one or both of the sound and image based on the data sets.

The sound generating apparatus according to the present invention is characterized by further including recording and reproduction means for recording data sets including separately input coordinate data sets and separately generated sound data sets, displayed-color data sets, and musical instrument data sets, and for synchronously reproducing one or both of the sound and image based on the data sets.

ADVANTAGE OF THE INVENTION

The sound generating method according to the present invention includes: a drawing and sound producing step of setting a drawing screen and producing a drawing by successively inputting coordinate data with a pen or mouse, and producing a sound by calculating two vectors from three successive sets of the coordinate data input at predetermined time intervals and generating sound data, the sound data having a sound pitch determined based on an angle variation between the calculated two vectors, a sound intensity determined based on a scalar quantity of the calculated two vectors, and a sound length determined based on a scalar quantity level of the calculated two vectors; and a displayed-color data generating step of temporarily displaying a hue circle on the drawing screen and moving a coordinate position with the nen or mouse to determine and generate displayed-color data to be displayed out of gradually changing displayed-color data, wherein operation using the pen or mouse causes the sound along with the drawing to be output and the displayed-color to be changed. Therefore, the method allows arbitrarily producing a sound and arbitrarily selecting a drawing color substantially only with drawing operations.

BRIEF DESCRIPTION OF THE DRAWINGS

FIG. 1 is a diagram showing a general configuration of a sound generating apparatus of the present invention;

FIG. 2 is a diagram for describing the relationship between coordinate data and vectors in the sound generating apparatus of the present invention;

FIG. 3 is a diagram showing a hue circle used to describe how to determine a displayed color in the sound generating apparatus of the present invention;

FIG. 4 is a diagram showing the hue circle used to describe how to determine a musical instrument in the sound generating apparatus of the present invention;

FIG. 5 is a diagram showing the main flow of a sound generation process in the sound generating apparatus of the present invention;

FIG. 6 is a diagram showing a flow of color selection processing in the sound generation process in the sound generating apparatus of the present invention;

FIG. 7 is a diagram showing a system configuration of an exemplary sound generating system of the present invention; and FIG. 8 is a diagram showing a system configuration of another exemplary sound generating system of the present invention.

DESCRIPTION OF SYMBOLS

10, 10*a* sound generating apparatus
12 coordinate input device
14 main control device
16 acoustic device
18 display device
20 motion calculation unit
22 sound data generating unit
24 musical instrument data generating unit and displayed-color data generating unit
26 data transfer and saving unit
28 MIDI sound source
30 timer
30*a*, 30*b* rhythm control and synchronization unit
32 coordinate buffer unit
34 vector calculation unit
36 sound data determination unit
38 musical theory database
40 color—musical instrument matching and determination unit
42 color—musical instrument matching database
44 data transfer unit
46 data saving unit
48 server unit
50 communication network

BEST MODE FOR CARRYING OUT THE INVENTION

An embodiment of a sound generating method according to the present invention will be described below.

First, a general configuration of the sound generating apparatus of the present invention that can suitable implement a sound generating method according to the present invention will be described with reference to FIG. 1.

The sound generating apparatus 10 of the present invention includes a coordinate input device (coordinate input means) 12, a main control device 14, an acoustic device (sound output means) 16, and a display device (image display means) 18.

The coordinate input device 12 is for inputting coordinate data about continuously or discontinuously drawn lines or pictures. A device of an appropriate type, such as a touch panel display or a mouse, may be used as the coordinate input device 12.

The main control device 14 may be, for example, a personal computer. The main control device 14 processes coordinate data signals from the coordinate input device 12 to send sound signals to the acoustic device 16 and image signals to the display device 18. The detailed configuration of the main control device 14 will be described later.

The acoustic device (sound output means) 16 may be, for example, a speaker system and produces sounds with the sound signals.

The display device 18 may be, for example, a liquid crystal display and displays images with the image signals.

The acoustic device 16 and the display device 18 may be integrated with the main control device 14. The display device 18 may be omitted as necessary.

The main control device 14 will be further described.

The main control device 14 includes a motion calculation unit (vector calculation means) 20, a sound data generating unit (sound data generating means) 22, a musical instrument data generating unit and displayed-color data generating unit (musical instrument data generating means and displayed-color data generating means) 24, a data transfer and saving unit 26, a sound source, e.g., a MIDI sound source 28, and a timer 30.

The motion calculation unit 20 calculates a vector having a magnitude and a direction from the coordinate data input at the coordinate input device 12 by connecting two coordinate positions successively input with a predetermined time interval. The motion calculation unit 20 has a coordinate buffer unit 32 and a vector calculation unit 34.

The coordinate buffer unit 32 temporarily stores the input coordinate data and includes a first coordinate buffer unit that directly takes the input coordinate data and second and third buffer units that sequentially shift the coordinate data in the first coordinate buffer unit at predetermined time intervals.

The vector calculation unit 34 calculates vectors from the coordinate data in the first to third coordinate buffer units and includes a scalar quantity calculation unit and an angle variation calculation unit.

The sound data generating unit 22 generates sound data based on the vectors calculated in the vector calculation unit 34. In the present case, MIDI data is generated.

The sound data generating unit 22 has a sound data determination unit 36 that generates the MIDI data. In the present case, the sound data generating unit 22 further has a musical theory database 38, which will be described in detail later.

The sound data determination unit 36 includes a sound intensity parameter determination unit that determines a sound intensity parameter based on the scalar quantity, and a sound pitch parameter determination unit that determines a sound pitch parameter based on the angle variation. Inversely, the sound pitch parameter may be determined based on the scalar quantity and the sound intensity parameter may be determined based on the angle variation.

In the sound data determination unit 36, a sound length (tempo) is obtained by, for example, configuring in such a manner that the sound data at the previous time is continuously generated if a vector variation obtained after the predetermined time interval is below a threshold.

Besides the above-described sound pitch, sound intensity, and sound length, the sound data may include the sound balance between the right and left, or the sound modulation. The sound data may include one or more selected from these five items.

The musical instrument data generating unit and displayed-color data generating unit 24 has a color—musical instrument matching and determination unit 40 and a color—musical instrument matching database 42. They serve both functions of generating musical instrument data and generating displayed-color data according to the coordinate data.

The color—musical instrument matching database 42 generates the displayed-color data and the musical instrument data based on the coordinate data. For example, the displayed-color data to be displayed on the display device 18 and the musical instrument data to be used as a material of sounds to be produced in the acoustic device 16 are laid out with respect to coordinate positions in the form of a hue circle and of musical instrument segments corresponding to the hue circle. Displaying the hue circle on the input screen and changing the coordinate position provides new displayed-color data and musical instrument data. The color—musical instrument matching and determination unit 40 matches the input coordinate data with the color—musical instrument matching database 42 to simultaneously determine the displayed-color data and the musical instrument data.

The data transfer and saving unit 26 includes a data transfer unit 44 that temporarily stores data, including the coordinate data, sent from the sound data generating unit 22 and from the musical instrument data generating unit and displayed-color data generating unit 24 respectively. The data transfer and saving unit 26 also includes a data saving unit 46 that saves the data as necessary.

The MIDI sound source 28 contains sounds for a plurality of kinds of musical instruments, and is controlled by signals of the sound data and the musical instrument data from the data transfer unit 42 to generate sound signals of a selected musical instrument. The sound signals are used to produce sounds in the acoustic device 16.

Meanwhile, signals of the coordinate data including the displayed-color data from the data transfer unit 42 are used to display on the display device 18 an image drawn at the input device 12.

The acoustic device 16 and the display device 18 may be simultaneously operated, or either one of them may be operated.

Now, how to calculate vectors from a change in the coordinate data and generating a sound based on a vector variation will be described with further reference to FIG. 2 and Tables 1 to 3.

The continuously or discontinuously changing coordinate data is taken into the coordinate buffer unit 32 in the motion calculation unit 20 at predetermined time intervals. Here, by way of example, the pen is shown being moved on the coordinate plane from the left to the right in FIG. 2 to successively obtain coordinate data 1 at a certain time (x1, y1, t1), coordinate data 2 at the time when the predetermined interval has passed since the coordinate data 1 was obtained (x2, y2, t2), and coordinate data 3 at the time when the predetermined interval has passed since the coordinate data 2 was obtained (x3, y3, t3), wherein (xi, yj) denotes coordinate values and tk denotes a time. As mentioned above, the times t1, t2, and t3 are apart with predetermined equal time intervals. The latest coordinate data 3 is taken into the first buffer unit, before which the coordinate data 2 is shifted from the first buffer unit to the second buffer unit and the coordinate data 1 is shifted from the second buffer unit to the first buffer unit.

In the angle variation calculation unit of the vector calculation unit 34, a vector a is obtained from the coordinate data 1 and the coordinate data 2, i.e., by connecting the two coordinate positions of the coordinate data 1 and the coordinate data 2. Similarly, a vector b is obtained from the coordinate data 2 and the coordinate data 3. Since the position of the coordinate data (xi, yi) is arbitrarily changed as the pen is moved, the vector b may be different from the vector a. For example, as shown in FIG. 2, if the pen is moved slowly in one direction during the period from the time t1 to the time t2 and moved quickly in a different direction during the period from the time t2 to the time t3, the vector b has a larger scalar value and a different vector direction relative to the vector a. The variation between the two vector directions successively obtained with the predetermined time interval is indicated by an angle variation θ in FIG. 2.

The sound data determination unit 36 in the sound data generating unit 22 generates a sound pitch (sound pitch data, a sound pitch parameter) according to the angle variation θ.

The angle variation θ may take a value between −180 and +180 degrees depending on the pen movement. The sound pitch is represented using note numbers (hereafter referred to as notes) for MIDI data. The notes include, for example, whole tones (white keys of the piano) and semitones (black keys of the piano) arranged with numbers 0 to 127.

Assigning the notes to values of the angle variation θ as shown in Table 1 allows any sound pitch to be taken depending on the pen movement.

TABLE 1

| θ | ... | −40 | −30 | −20 | −10 | 0 | +10 | +20 | +30 | +40 | ... |
|---|---|---|---|---|---|---|---|---|---|---|---|
| note variation | ... | −4 | −3 | −2 | −1 | 0 | +1 | +2 | +3 | +4 | ... |
| note | ... | 56 | 57 | 58 | 59 | 60 | 61 | 62 | 63 | 64 | ... |

The musical theory database 38 in the sound data generating unit 22 will also be described here.

Besides the data for allowing any sound pitch to be specified according to the angle variation θ as shown in Table 1, the musical theory database 38 further contains data about scales in terms of chords as shown in Table 2 (the C chord is shown here) or ethnic scales as shown in Table 3 (the Okinawan scale is shown here) corresponding to the angle variation θ.

Thus, a preferred melody can be obtained by performing an operation for applying the musical theory when sounds are generated.

TABLE 2

| θ | ... | −40 | −30 | −20 | −10 | 0 | +10 | +20 | +30 | +40 | ... |
|---|---|---|---|---|---|---|---|---|---|---|---|
| note variation | ... | −17 | −12 | −8 | −5 | 0 | +4 | +7 | +12 | +16 | ... |
| note | ... | 43 | 48 | 52 | 55 | 60 | 64 | 67 | 72 | 76 | ... |

TABLE 3

| θ | ... | −40 | −30 | −20 | −10 | 0 | +10 | +20 | +30 | +40 | ... |
|---|---|---|---|---|---|---|---|---|---|---|---|
| note variation | ... | −8 | −7 | −5 | −1 | 0 | +4 | +5 | +7 | +11 | ... |
| note | ... | 42 | 43 | 55 | 59 | 60 | 64 | 65 | 67 | 71 | ... |

The scalar quantity calculation unit in the vector calculation unit 34 calculates the scalar quantity of the vectors a and b from the respective vectors. Then, the sound data determination unit 36 in the sound data generating unit 22 generates the sound intensity (sound intensity data, a sound intensity parameter) according to the scalar quantity of the vectors a and b. In other words, the sound intensity can be changed by changing the scalar quantity of the vectors.

Assuming that the maximum width of the coordinate plane is 1 and the scalar quantity obtained by moving the pen is represented as L, L may take a value in the range from 0 to 1. The sound intensity is represented using volume (hereafter referred to as volume) for MIDI data. The volume is assumed to take the numbers 0 to 127.

Then, the sound intensity is generated according to the scalar quantity by setting the relationship between the scalar quantity L and the volume as in the following exemplary equation.

$$\text{volume}=(1-L)^{*120}$$

In this case, a slower pen movement makes the value of the scalar quantity L smaller, thereby resulting in a higher sound intensity.

Here, the sound length (tempo) may be generated by making a setting such that a sound intensity generated according to a scalar quantity at the previous time is maintained if the scalar quantity L is below a threshold.

Now, with reference to FIG. 3, description will be given of how to select a displayed color when the display device 18 is used to display a picture drawn by the pen.

As shown in FIG. 3, a hue circle is set in which the hue h is assigned in the angle range of 360 degrees around the center point of the coordinate plane. In the hue circle, the saturation s is assigned in such a manner that colors closer to the center point of the coordinate plane are fainter and colors farther from the center point of the coordinate plane are stronger.

The hue circle is displayed on the coordinate plane by operating color setting means such as a color selection button. Then, the hue of a displayed color can be changed by moving the pen placed at a current coordinate position P(x,y) in the plane coordinate system to another coordinate position to change the angle in the hue circle. The saturation of the displayed color can be changed by changing the distance from the center of the hue circle. When a mouse is used, the displayed color can be changed by dragging with the right button.

At this point, a desired brightness can be obtained by making a setting such that the brightness is changed according to the length of time during which the pen is not moved but fixed at the same coordinates.

Now, with reference to FIG. 4 and Tables 4 to 8, description will be given of how to associate displayed colors and musical instruments and select a musical instrument corresponding to a displayed color.

As shown in FIG. 4, the hue circle in FIG. 3 is divided into twelve segments, for example, and each of the colors A to L is assigned a musical instrument. Program Numbers, for example those in a tone map shown in Table 4, of the MIDI sound source 28 may be directly assigned in a mechanical manner as shown in Table 5, or preferred Program Numbers may be assigned as shown in Table 6. Alternatively, separately provided drum set numbers, such as drum set numbers 1 shown in Table 7, may be assigned as shown in Table 8.

In this manner, a musical instrument can be determined along with the displayed color. When image display is not provided, only a musical instrument may be determined by performing operations on the coordinate plane.

TABLE 4

| | | | | |
|---|---|---|---|---|
| 1. | Piano | | 9. | Reed |
| 1 | Piano1 | Piano 1 | 65 | Soprano Sax |
| 2 | Piano2 | Piano 2 | 66 | Alto Sax |
| 3 | Piano3 | Piano 3 | 67 | Tenor Sax |
| 4 | Honky-tonk | Honky-ton k | 68 | Baritone Sax |
| 5 | E. Piano1 | E. Piano 1 | 69 | Oboe |
| 6 | E. Piano2 | E. Piano 2 | 70 | English Horn |
| 7 | Harpsichord | Harpsichord | 71 | Bassoon |
| 8 | Clav. | Clav. | 72 | Clarinet |
| 2. | Chromatic Percussion | | 10. | Pipe |
| 9 | Celesta | Celesta | 73 | Piccolo |
| 10 | Glockenspiel | Glockenspiel | 74 | Flute |
| 11 | Music Box | Music Box | 75 | Recorder |
| 12 | Vibraphone | Vibraphone | 76 | Pan Flute |
| 13 | Marimba | Marimba | 77 | Bottle Blow |
| 14 | Xylophone | Xylophone | 78 | Shakuhachi |
| 15 | Tubular-bell | Tubular-bell | 79 | Whistle |
| 16 | Santur | Santur | 80 | Ocarina |
| 3. | Organ | | 11. | Synth lead |
| 17 | Organ1 | Organ 1 | 81 | Square Wave |
| 18 | Organ2 | Organ 2 | 82 | Saw Wave |
| 19 | Organ3 | Organ 3 | 83 | Syn. Calliope |
| 20 | Church Org.1 | Church Org.1 | 84 | Chiffer Lead |
| 21 | Reed Organ | Read Organ | 85 | Charang |
| 22 | Accordion Fr | Accordion | 86 | Solo Vox |
| 23 | Harmonica | Harmonica | 87 | 5th Saw Wave |
| 24 | Bandon eon | Bandoneon | 88 | Bass & Lead |
| 4. | Guitar | | 12. | Synthspad |

TABLE 5

| color (see Figure) | A | B | C | D | E | F | G | H | I | J | K | L |
|---|---|---|---|---|---|---|---|---|---|---|---|---|
| MIDI Program No. | 1 | 2 | 3 | 4 | 5 | 6 | 7 | 8 | 9 | 10 | 11 | 12 |

TABLE 6

| color (see Figure) | A | B | C | D | E | F | G | H | I | J | K | L |
|---|---|---|---|---|---|---|---|---|---|---|---|---|
| MIDI Program No. | 1 | 24 | 8 | 85 | 42 | 33 | 56 | 102 | 26 | 10 | 63 | 12 |

TABLE 7

| | |
|---|---|
| 35 | Acoustic Bass Drum |
| 36 | Bass Drum 1 |
| 37 | Side Stick |
| 38 | Acoustic Snare |
| 39 | Hand Clap |
| 40 | Electric Snare |
| 41 | Low Floor Tom |
| 42 | Closed Hi Hat |
| 43 | High Floor Tom |
| 44 | Pedal Hi-Hat |
| 45 | Low Tom |

TABLE 8

| color (see Figure) | A | B | C | D | E | F | G | H | I | J | K | L |
|---|---|---|---|---|---|---|---|---|---|---|---|---|
| Drum Set No. | 1 | 2 | 3 | 4 | 5 | 6 | 7 | 8 | 9 | 10 | 11 | 12 |

The above-described data for selecting the displayed color and data for selecting the musical instrument are contained in the color—musical instrument matching database 42. The color—musical instrument matching and determination unit 40 matches the data with the input coordinate data to determine the displayed color and the musical instrument.

Now, with reference to flowcharts of FIGS. 5 and 6, description will be given of processing for producing sounds and displaying images by the sound generating apparatus 10 of the present invention.

When an operator using the sound generating apparatus 10 starts operation (S1 in FIG. 5), initialization of settings such as the time and the coordinate data is performed (S2 in FIG. 5).

Then, mode is checked (S3 in FIG. 5), and the operator selects the color if desired (S22 in FIG. 5). The color selection processing will be described later. If the color is not selected, drawing is performed based on a default color condition.

If the color is not selected, it is determined whether the drawing (dragging) has been started (S4 in FIG. 5). Subsequently the drawing is initialized, i.e., the initial successive two pairs of coordinates (Pbuf3 and Pbuf2) are shifted to the third and second buffers (S5 in FIG. 5). If the drawing has not been started, the process returns to the mode check step S3.

Then, it is determined whether the drawing is being performed with timing corresponding to the rhythm (the sound length, tempo) (S6 in FIG. 5).

If the drawing is being performed with timing corresponding to the rhythm, the current coordinates P being drawn (which may hereafter be referred to as the current coordinates), i.e., the current coordinate data is obtained (S7 in FIG. 5). Subsequently, the current coordinates P is compared with the previous coordinates (Pbuf2) (S8 in FIG. 5).

If the difference between the values of the current coordinates P and the values of the previous coordinates (Pbuf2) of a predetermined time ago is below a threshold, the process returns to step S6 of determining whether the drawing is being performed with timing corresponding to the rhythm. If the difference between the values of the current coordinates P and the values of the previous coordinates (Pbuf2) is equal to or above the threshold, the current coordinates P are assigned to the first buffer (Pbuf1, S9 in FIG. 5). At this point, if the previous sound is still being produced although the coordinate values have changed, "note off" is sent to the MIDI sound source 28. For example, when a musical instrument that maintains a sound without fade-out such as a wind instrument is being selected, the previous sound (current sound) is stopped for producing the next sound (S10 in FIG. 5).

The angle variation θ between the two vectors and the scalar quantity L of each vector are calculated from the coordinate data in the first to third buffers (Pbuf1 to Pbuf3) (S11 in FIG. 5).

Then, the MIDI data and the screen display data are generated from the angle variation θ and the scalar quantities L for the vectors, as well as from the default or selected color and the musical instrument selected (specified) for the color (S12 in FIG. 5).

In this example, it is assumed that a plurality of operators make drawings and sounds by turns, and thereafter these drawings and sounds are synchronously reproduced. Therefore, the sound generating apparatus 10 undergoes the following processing.

The generated data is saved in a list, and the sound duration is added to the data (S13 in FIG. 5).

Then, each buffer is shifted backward (S14 in FIG. 5). It is further determined whether the generated data has exceeded a specified amount (S15 in FIG. 5). If the generated data has not been exceeded the specified amount, it is determined whether the operator has finished the drawing (S16 in FIG. 5). If the operator has finished the drawing, i.e., lifted up the pen or finished dragging, the process returns to the mode check step S3. If the operator is still drawing, the process returns to the timing check step S6 to further obtain new coordinates. When there is only one operator, the process skips step S15 and proceeds to step S16.

In step S15 of determining whether the generated data has exceeded the specified amount, if it is determined that the specified amount has been exceeded, it is further determined whether the specified number of operators has been reached (S17 in FIG. 5). If the specified number of operators has been reached, the processing terminates (S18 in FIG. 5). If the predetermined number of operators has not been reached, operation by another operator is performed (omitted in FIG. 5).

Meanwhile, once the MIDI data and the screen display data are generated (S12 in FIG. 5), screen display is provided (S19 in FIG. 5) or the MIDI data is sent to the MIDI sound source (S20 in FIG. 5) to produce sounds (S21 in FIG. 5), in real time based on these data items. Alternatively, the screen display and the sounds may be provided based on stored data. In that case, if there are a plurality of operators, a plurality of drawings are produced on the same screen and simultaneous playing (a session) is performed.

For a plurality of operators, the multiple drawing and the simultaneous playing may be concurrently performed, or either one of the multiple drawing and the simultaneous playing may be performed.

Now, the color selection processing will be described. When the color selection is started by, for example, the above-mentioned operation of putting down the pen (S23 in FIG. 6), current coordinates P are obtained (S24 in FIG. 6).

Then, the positional relationship between the center point O of the valid range in the above-described hue circle and the current coordinates P is calculated (S25 in FIG. 6). It is further determined whether the pen has been lifted up (S26 in FIG. 6).

If the pen has been lifted up, the hue h and the saturation s are determined based on the central angle in the hue circle and the distance from the center point of the hue circle respectively (S27 in FIG. 6). The color selection is finished (S28 in FIG. 6) and the process returns to the main routine for performing the drawing.

If the pen is still contacted, it is determined whether the coordinates after a threshold time are the same as the previous coordinates P (S29 in FIG. 6).

If the new coordinates are different from the previous coordinates P, the new coordinates are obtained as the current coordinates (S24 in FIG. 6). If the new coordinates are the same as the previous coordinates P, it is determined whether the brightness is the maximum. The brightness is increased if the brightness is not the maximum (S31 in FIG. 6), whereas the brightness is minimized if the brightness is the maximum (S32 in FIG. 6). The process then returns to step S26 for determining whether the pen has been lifted up.

Instead of allowing a plurality of persons to provide inputs by turns, the sound generating apparatus 10 of the present invention may use, as the coordinate input device 12, a device with which a plurality of persons can simultaneously input the coordinate data. The main control device 14 may then be configured to simultaneously process a plurality of coordinate data sets.

In the sound generating apparatus 10 of the present invention, a three-dimensional input device such as a three-dimensional mouse may be used as the coordinate input device 12 to generate the sound data based on three-dimensional vectors.

In the sound generating apparatus 10 of the present invention, the coordinate input device 12 may be a device that allows the position of an object shot by a camera to be input as the coordinate data.

In the sound generating apparatus 10 of the present invention, a fading line may be represented according to the magnitude of the scalar quantity of the vectors, or in other words, according to the moving speed of the pen. A tool such as a selection switch may also be provided to change the thickness of a drawn line.

Now, a sound generating system configured with a plurality of sound generating apparatus 10 of the present invention will be described with reference to FIGS. 7 and 8.

The sound generating system of the present invention includes a plurality of above-described sound generating apparatus 10 connected with each other over a communication network. Each sound generating apparatus 10 synchronously generates sounds and images, or records and reproduces them as needed. The data may be communicated in real time or with a time lag. In the latter case, for example, the data from one or more sound generating apparatus 10 may be received and recorded by another sound generating apparatus 10, which may then overlay its own data on the recorded data from the other apparatus. Instead of synchronously generating sounds and images, the sound generating apparatus 10 may synchronously generate either sounds or images.

In an exemplary sound generating system, as shown in FIG. 7, two sound generating apparatus 10 for example are directly connected over a communication network (not shown, see FIG. 8). In FIG. 7, reference symbol 30*a* denotes a rhythm control and synchronization unit including the timer 30.

Data sets, including the coordinate data sets input at each sound generating apparatus 10 and the sound data sets, displayed-color data sets, and musical instrument data sets generated according to the coordinate data are recorded in the data saving unit 26 of each sound generating apparatus 10. These data sets are communicated, for example in real time, and sounds and images are synchronously generated based on the data sets controlled and synchronized by the rhythm control and synchronization unit 30*a*. Again, instead of synchronously generating sounds and images, the sound generating apparatus 10 may synchronously generate either sounds or images.

In another exemplary sound generating system, as shown in FIG. 8, three sound generating apparatus 10*a* for example are connected over a communication network 50 via a server unit 48.

In this case, the data saving unit 46 and a rhythm control and synchronization unit 30*b* are provided in the server unit 48. As in the sound generating system in FIG. 7, the data sets from the three sound generating apparatus 10 are communicated, for example in real time, and sounds and images are synchronously generated based on the data sets controlled and synchronized by the rhythm control and synchronization unit 30*b*. Again, instead of synchronously generating sounds and images, the sound generating apparatus 10 may synchronously generate either sounds or images.

The sound generating system of the present invention allows people at different places to perform a session.

The sound generating method of the present invention allows simultaneously drawing a picture and playing music, so that it provides personal entertainment and can also be used as a new expression tool for artists.

The use of the sound generating method of the present invention is not limited to playing music. For example, by converting movements of a pen used to write characters such as a signature into speech, the sound generating apparatus 10 may be utilized as a new tool for authenticating signatures or for communicating visual information to visually impaired people. Since sounds can be readily created from movements of a hand, the sound generating apparatus 10 may also be applied as a tool for rehabilitation or for prevention of senile dementia. Similarly, the sound generating apparatus 10 may also be applied to sentiment education or learning of colors and sounds for children.

The invention claimed is:

1. A sound generating method comprising:

producing a drawing on a display by successively inputting coordinate data with a pen or mouse;

calculating two vectors from three successive sets of the coordinate data input at predetermined time intervals;

generating sound data, die sound data having a sound pitch determined based on an angle variation between the calculated two vectors, a sound intensity determined based on a scalar magnitude of the calculated two vectors, and a sound length determined based on a scalar magnitude level of the calculated two vectors;

temporarily displaying a hue circle on a drawing screen and moving a coordinate position with the pen or mouse to determine and generate displayed-color data; and producing sound from the sound data;

whereby operation using the pen or mouse causes the sound along with the drawing to be output and the displayed-color to be changed.

2. The sound generating method according to claim 1, characterized in that the sound producing step comprises generating sound data on only tones of a certain scale based on the angle variation between the vectors.

3. The sound generating method according to claim 1, characterized in that the displayed-color data generating step comprises segmenting in that the hue circle and associating each segment thereof with a musical instrument; and generating musical instrument data along with the displayed-color data.

4. The sound generating method according to any one of claims 1 to 3, further comprising recording data sets including separately input coordinate data sets and separately generated sound data sets, displayed-color data sets, and musical instrument data sets, and synchronously reproducing one or both of the sound and image based on the data sets.

* * * * *